US006244153B1

(12) United States Patent
McInnes et al.

(10) Patent No.: US 6,244,153 B1
(45) Date of Patent: Jun. 12, 2001

(54) BAGEL SLICING APPLIANCE

(76) Inventors: Thomas A. McInnes, 7816 Ruxwood Rd., Ruxton, MD (US) 21204; Louis Toth, 3220 Regents Row, West Friendship, MD (US) 21794; Gordon R. Perry, 121 W. 3rd St., New York, NY (US) 10012; Jude C. Tan, 112-02 111th Ave. South Ozone Park, New York, NY (US) 11420

( * ) Notice: Subject to any disclaimer, the term of this patent is extended or adjusted under 35 U.S.C. 154(b) by 0 days.

(21) Appl. No.: 09/351,479

(22) Filed: Jul. 13, 1999

Related U.S. Application Data

(63) Continuation-in-part of application No. 08/845,595, filed on Apr. 25, 1997, now Pat. No. 5,921,163.
(60) Provisional application No. 60/016,067, filed on Apr. 25, 1996.

(51) Int. Cl.[7] ..... B26D 3/00
(52) U.S. Cl. ..... 83/870; 83/647; 83/759; 83/932
(58) Field of Search ..... 83/167, 758, 871, 83/870, 932, 647, 697, 759, 776, 782

(56) References Cited

U.S. PATENT DOCUMENTS 4,050,370 * 9/1977 Schmidt et al. ..... 99/538
5,522,306 * 6/1996 DeMars ..... 99/329 RT
5,921,163 * 7/1999 McInnes et al. ..... 83/870
6,145,427 * 11/2000 Smith ..... 83/874

* cited by examiner

*Primary Examiner*—Lee Young
*Assistant Examiner*—Kevin G. Vercene
(74) *Attorney, Agent, or Firm*—Law Offices of Royal W. Craig

(57) ABSTRACT

An improved appliance for slicing food articles, particularly baked goods and bagels in a uniform, quick and safe manner. The appliance includes a food receptacle which is slidably inserted into one end of a main housing and into which a food item such as a bagel is placed. A motorized cutting carriage is pivotally mounted to the main housing and extends a serrated dual-bladed slicing assembly over the food item. When power is applied, the blades of the slicing assembly begin reciprocating, and the entire cutting carriage is pivoted with respect to the main housing in order to move the reciprocating blades of the slicing assembly through the food item. Once the food item is cut, the cutting carriage is returned to its home position, the food receptacle is slidably withdrawn, and the sliced food item is removed and consumed. The appliance requires a minimum of space and facilitates the slicing operation without damage to the bagel. The appliance is efficient, quick, easy to clean, and above all, completely safe.

1 Claim, 9 Drawing Sheets

BAGEL SLICING APPLIANCE

CROSS REFERENCE TO RELATED APPLICATIONS

Priority of this application is based on provisional application Seral No.: 60/016,067, filed Apr. 25, 1996, now abandoned, and is further a Continuation-In-Part application of U.S. patent application Ser. No. 08/845,595 Apr. 25, 1997 U.S. Pat. No. 5,921,163.

BACKGROUND OF THE INVENTION

1. Field of the Invention

The present invention relates to kitchen appliances and, more particularly, to a motorized food slicing appliance to simplify the cutting of bagels and other baked goods, and to increase safety.

2. Description of the Background

The conventional means for slicing food articles, particularly baked goods such as bagels, doughnuts and the like, entails a simple carving knife and cutting board. However, this engenders a significant safety hazard. Safety is especially compromised in the cutting of bagels, which are hard and round and thereby difficult to stabilize. It is recognized that bagel slicing is one of the foremost causes of household injury. Hospitals routinely treat an inordinate number of lacerated fingers caused thereby.

A number of machines and jigs for slicing bagels already exist in the prior art. These generally fall into two categories: 1) manual holding jigs or receptacles into which the bagel is placed to hold it during a conventional knife cutting operation; and 2) industrialized slicing machines designed to slice a large number of bagels or baked goods in an assembly-line manner.

Many of the former manually-operated devices include a receptacle having a pair of opposed slots into which is inserted a cutting instrument, which is then moved back and forth in a sawing action to slice the bagel while it is held by the receptacle. Specifically, U.S. Pat. No. 4,399,989 to Baillie shows a mechanical bagel press for securing bagels whilst cutting with a knife, and U.S. Pat. No. 4,807,505 to Campbell et al. shows a miter-box type manual bagel slicer for securing a bagel and guiding a knife. In these and other cases, the use of a separate knife to slice the bagel is not always convenient and leaves the risk of injury from the knife blade. Other variations attach the knife blade to the housing to facilitate the sawing action. Still others employ a special guided blade or make provision for rotating the bagel to facilitate slicing. Examples include U.S. Pat. No. 4,747,331 to Policella, which shows a mechanical bagel press for securing bagels whilst cutting with a pivotally mounted knife, and U.S. Pat. No. 5,431,078 to Ricard et al. which shows a manual guillotine-type bagel slicing jig. These and like devices still result in a labor intensive process and user interaction with a free-swinging blade. Injuries are still prevalent.

There are heavy commercial devices used by restaurants and the like. These industrialized devices entail automatically feeding bagels past rotating blades. They are designed for use where ample counter space and a high price tag are not obstacles. For example, U.S Pat. No. 5,404,782 to Ryan et al. shows an automated slicer in which bagels or other baked goods are carried on a conveyer past two opposing horizontal blades. The baked goods are sliced by the blades and continue onward until they are ejected from the conveyer into a hopper. Similarly, U.S. Pat. No. 4,776,252 to Herlitzius shows an automated slicer in which bagels are carried on a conveyer to a rotary slicer. The bagels are sliced by adjustable blades and continue onward until they fall off the conveyer into a hopper.

It would be greatly advantageous to provide a compact motorized bagel slicing device adapted for home or light commercial use, thereby simplifying the slicing process and improving the safety thereof. While there have been efforts to achieve a balance between automation, safety, and simplicity, none as yet have yielded a satisfactory design. For instance, U.S. Pat. No. 4,546,686 to Losiowski shows a bagel slicing jig in which a bagel is inserted through an entrance door in advance of a pushing mechanism. The handle operated pushing mechanism urges the bun past a diagonal blade. After slicing, the bun is ejected from the side of the jig. U.S. Pat. No. 2,685,901 to Putzer shows a bun slicing machine in which a round bun is inserted in a slidable carriage. The carriage and bun are shifted via a handle such that the bun encounters a diagonal blade. After slicing, the bun falls into an exit hopper for removal. These devices remain bulky, difficult to use and clean, and expensive to manufacture. They could be better designed for simplicity, compactness, ease of operation, more economical manufacturing, and ease of cleaning. It is believed that a well-designed modular unit striking a better balance between manual and motorized operation would find a significant market.

SUMMARY OF THE INVENTION

In accordance with the above, it is an object of the present invention to provide an improved apparatus for slicing food articles, particularly baked goods and bagels in a uniform, quick and safe manner.

Another object of the invention is to provide an improved semi-automatic bagel slicer that requires a minimum of space and which facilitates the slicing operation without damage to the bagel.

Another object of the invention is to provide an improved bagel slicer which is efficient, quick, easy to clean, and above all, completely safe.

These and other objects are provided by an improved appliance for slicing food articles, particularly baked goods and bagels, in a uniform, quick and safe manner.

The appliance of the instant invention includes a food receptacle which is slidably inserted into one end of a main housing and into which a food item such as a bagel may be placed. A motorized cutting carriage is pivotally mounted to the main housing and extends a serrated dual-bladed slicing assembly over the food item. When power is applied, the blades of the slicing assembly begin reciprocating, and the cutting carriage is pivoted with respect to the main housing in order to move the reciprocating blades through the food item. Once the food item is cut, the cutting carriage is returned to its home position, the food receptacle can be slidably withdrawn, and the sliced food item is removed. The appliance requires a minimum of space and facilitates the slicing operation without damage to the bagel. The appliance is efficient, quick, easy to clean, and above all, completely safe.

BRIEF DESCRIPTION OF THE DRAWINGS

Other objects, features, and advantages of the present invention will become more apparent from the following detailed description of preferred embodiments and certain modifications thereof when taken together with the accompanying drawings in which.

DETAILED DESCRIPTION OF THE PREFERRED EMBODIMENTS

Figure 1:
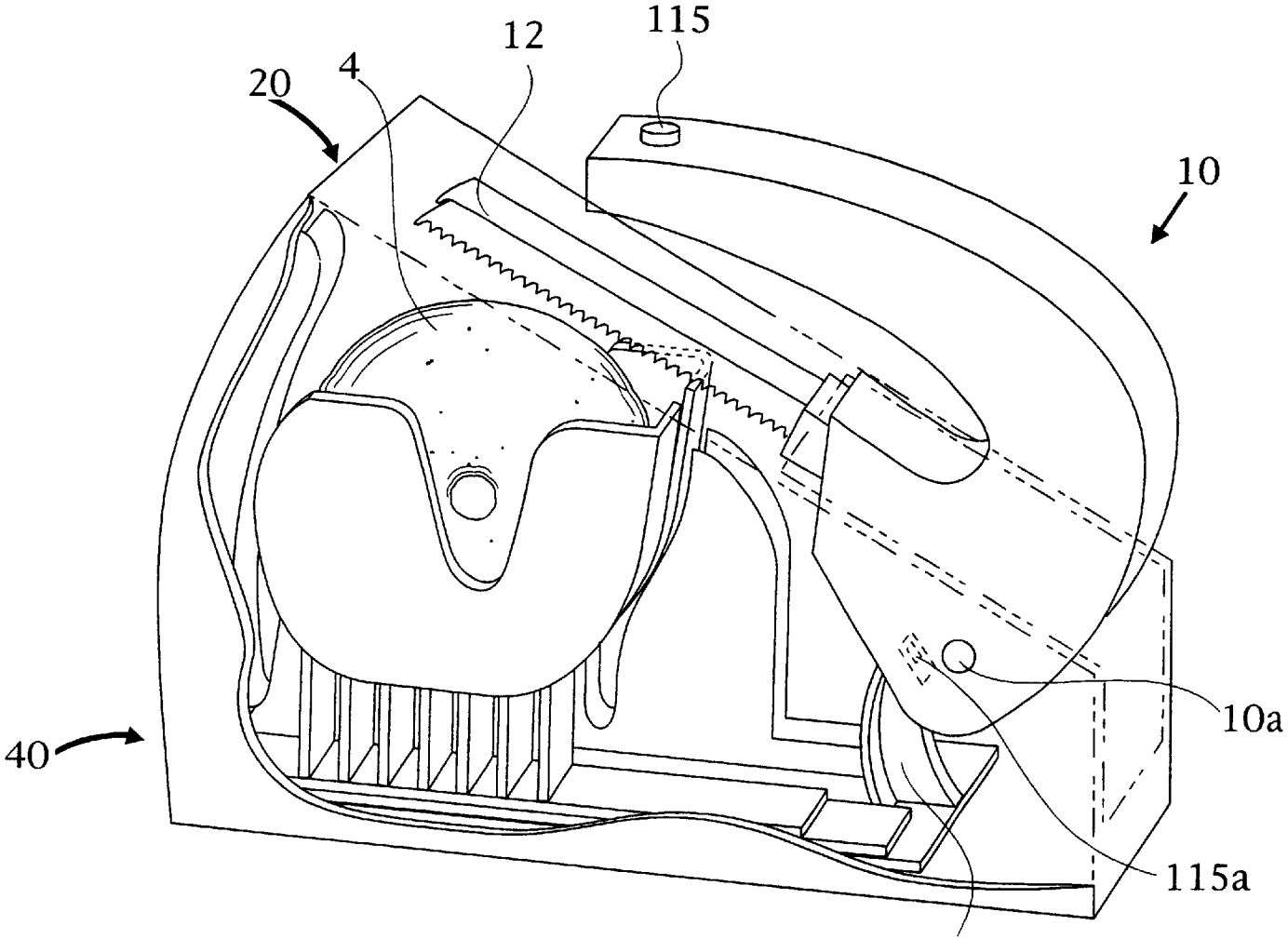
FIG. 1 is a front perspective view of a bagel slicing appliance in accordance with the present invention.

FIG. 1 is a side view of a bagel slicing appliance in accordance with one embodiment of the present invention. The device generally includes a clear main housing 20 formed as a somewhat triangularly shaped enclosure. While main housing 20 as described and shown herein is clear, it may optionally be provided with any opaque or colored appearance. A bagel 4 or other food item is seated in a food receptacle drawer 40, which in turn is slidably inserted into one end of the main housing 20. A motorized cutting carriage 10 is pivotally mounted to one end of the main housing 20 and is adapted for pivoting a serrated dual bladed slicing assembly 12 downward towards the bottom of main housing 20 for guided slidable depression into said receptacle drawer 40. Serrated dual-bladed slicing assembly 12 extends outwardly from the cutting carriage 10 within the confines of main housing 20. Dual-bladed slicing assembly 12 is actuated by a drive mechanism internal to the cutting carriage 10 (to be described) and is driven to reciprocate for slicing through the food item 4. In operation, the entire cutting carriage is pivoted about pivot pin 10*a* towards the bottom floors of main housing 20 and food receptacle drawer 40 in order to move the reciprocating blades of slicing assembly 12 through the food item 4. An on/off switch 115 is provided at the top of cutting carriage 10 which, when activated, applies power to the internal drive mechanism to begin reciprocation of the slicing assembly 12. A secondary safety switch 115*a* is also provided at the bottom portion of cutting carriage 10 and positioned for engagement with a vertically-extending finger 200 on receptacle drawer 40 when drawer 40 is properly seated within main housing 20. Secondary safety switch 115*a* interrupts the circuit between on/off switch 115*a* and a power source such that the device is rendered unoperational unless receptacle drawer 40 is properly seated within main housing 20.

Once the food item is cut, on off switch 115 is released and cutting carriage 10 is pivoted about pivot point 10*a* to withdraw slicing assembly 12 from receptacle drawer 40, releasing finger 200 to enable food receptacle drawer 40 to be slidably withdrawn from main housing 20, and the sliced food item 4 can be removed and consumed. The serrated dual-bladed slicing assembly 12 makes short work of the slicing and results in a clean uniform cut through the food item 4. The main housing 20 completely shields the user from the serrated dual-bladed slicing assembly 12, and no injury is possible.

Figure 2:
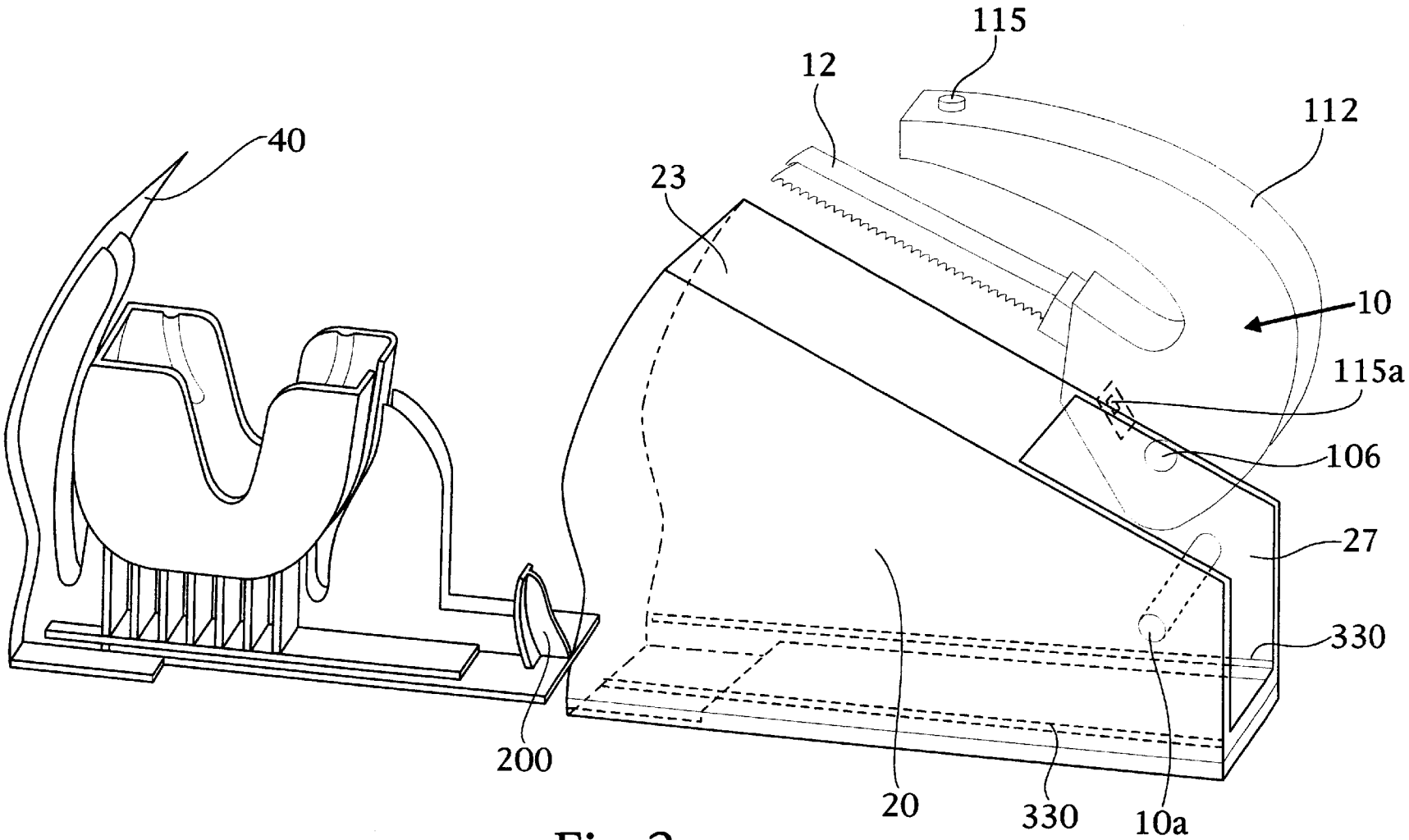
FIG. 2 is an exploded perspective view of the bagel slicing appliance of FIG. 1.

FIG. 2 is an exploded perspective view of the bagel slicing appliance of FIG. 1 that better shows the cooperation of the food receptacle drawer 40 as it is adapted for slidable insertion into one end of the main housing 20. Main housing 20 is here shown with a top wall 23 for added safety. Top wall 23 covers nearly the entirety of the uppermost portion of main housing 20, leaving only a window 27 at the rear, bottom portion of top wall 23 for the upper extent of cutting carriage 10 to extend through. When assembled, the motorized cutting carriage 10 is positioned with its lower portion permanently retained within housing 20, and pivotally attached thereto through bore hole 10*b* via pivot pin 10*a*.

Figure 3:
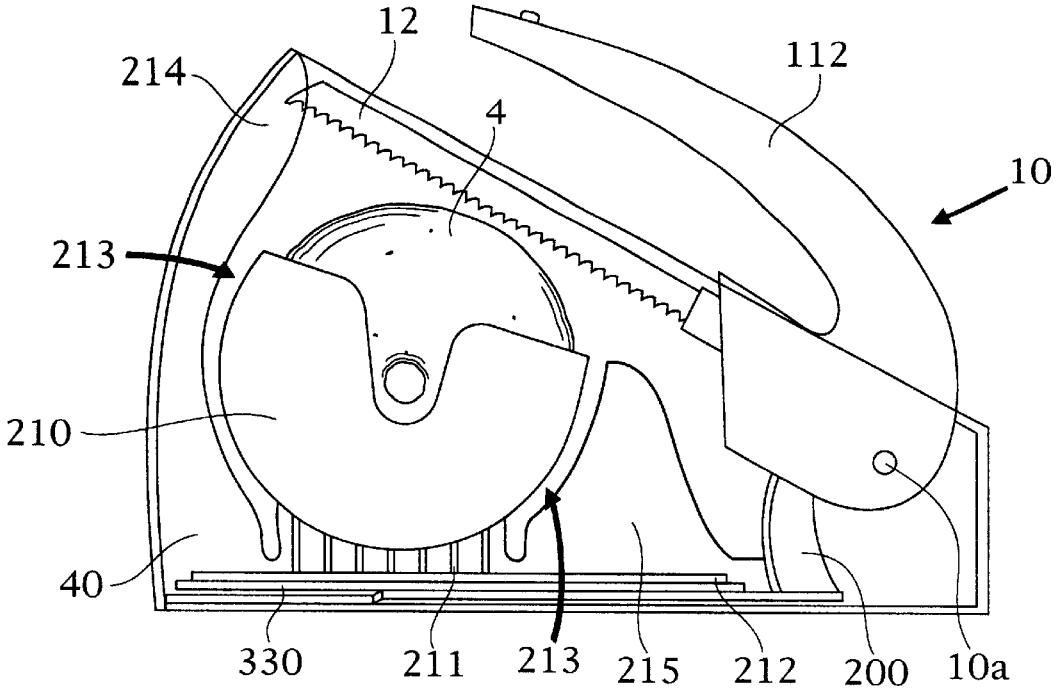
FIG. 3 is a side view of the bagel slicing appliance of FIGS. 1 and 2.
Figure 4:
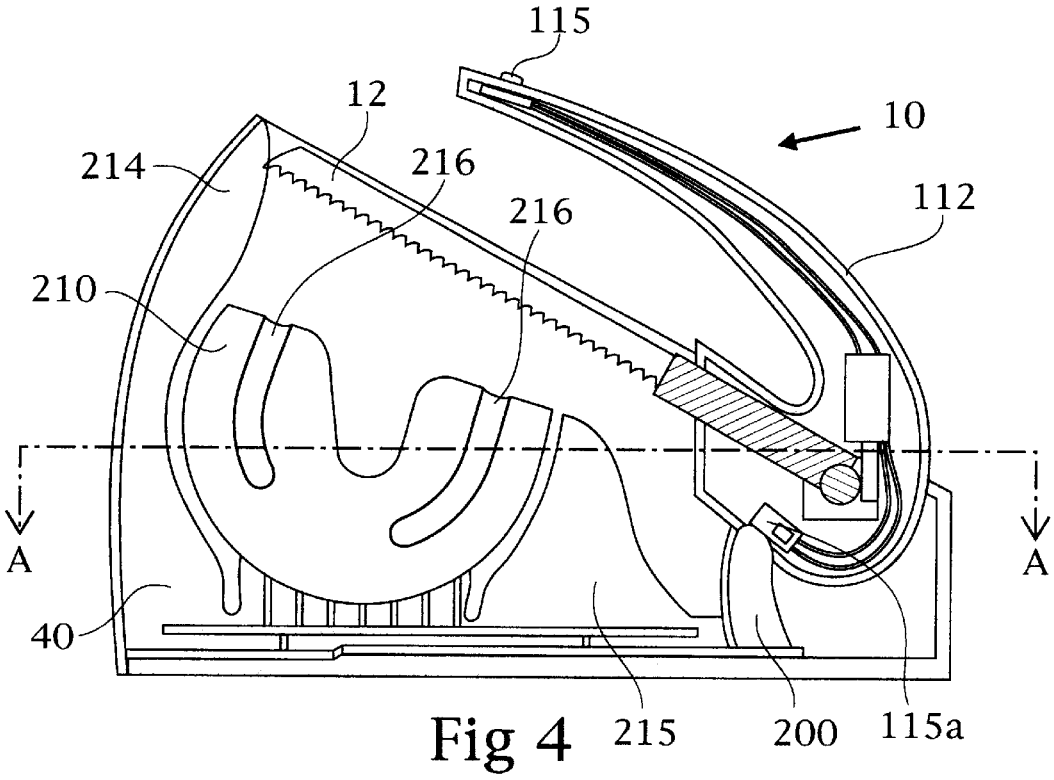
FIG. 4 is a side cut-away view of the bagel slicing appliance as in FIG. 3.

FIG. 3 is a side view of the bagel slicing appliance of FIGS. 1 and 2, and FIG. 4 is a side cut-away view of the bagel slicing apparatus as in FIG. 3. Once seated in food receptacle 40 and inserted into the main housing 20, the bagel 4 or other food item becomes positioned below and within the path of travel of the blades of serrated dual-bladed slicing assembly 12. The motorized cutting carriage 10 comprises a cutting carriage handle housing 112, and is provided with pivot pin 10*a* at its lower rear section for pivotal attachment to main housing 20. A push contact on/off switch 115 is provided at the uppermost portion of handle housing 112, and is connected between the power source and the motorized internal drive assembly (to be described) to apply power thereto. A secondary push contact switch 115*a* is also provided at the bottom extent of handle housing 112 and positioned within its hollow interior. Secondary push contact switch 115*a* is a safety switch that interrupts the circuit running from the power source to the motorized internal drive assembly. When food receptacle 40 is fully inserted into main housing 20, vertical extension finger 200 on food receptacle 40 comes into contact with and depresses mechanical push contact switch 115*a*. When secondary push contact switch 115*a* is depressed, the user may in turn depress switch 115 on the top of cutting carriage 10 to power the internal drive mechanism to begin reciprocation of the slicing assembly 12. As the cutting carriage 10 is depressed further downward, the secondary push contact switch 115*a* remains depressed and the reciprocating blades of slicing assembly 12 pass through the food item 4.

Figure 5:
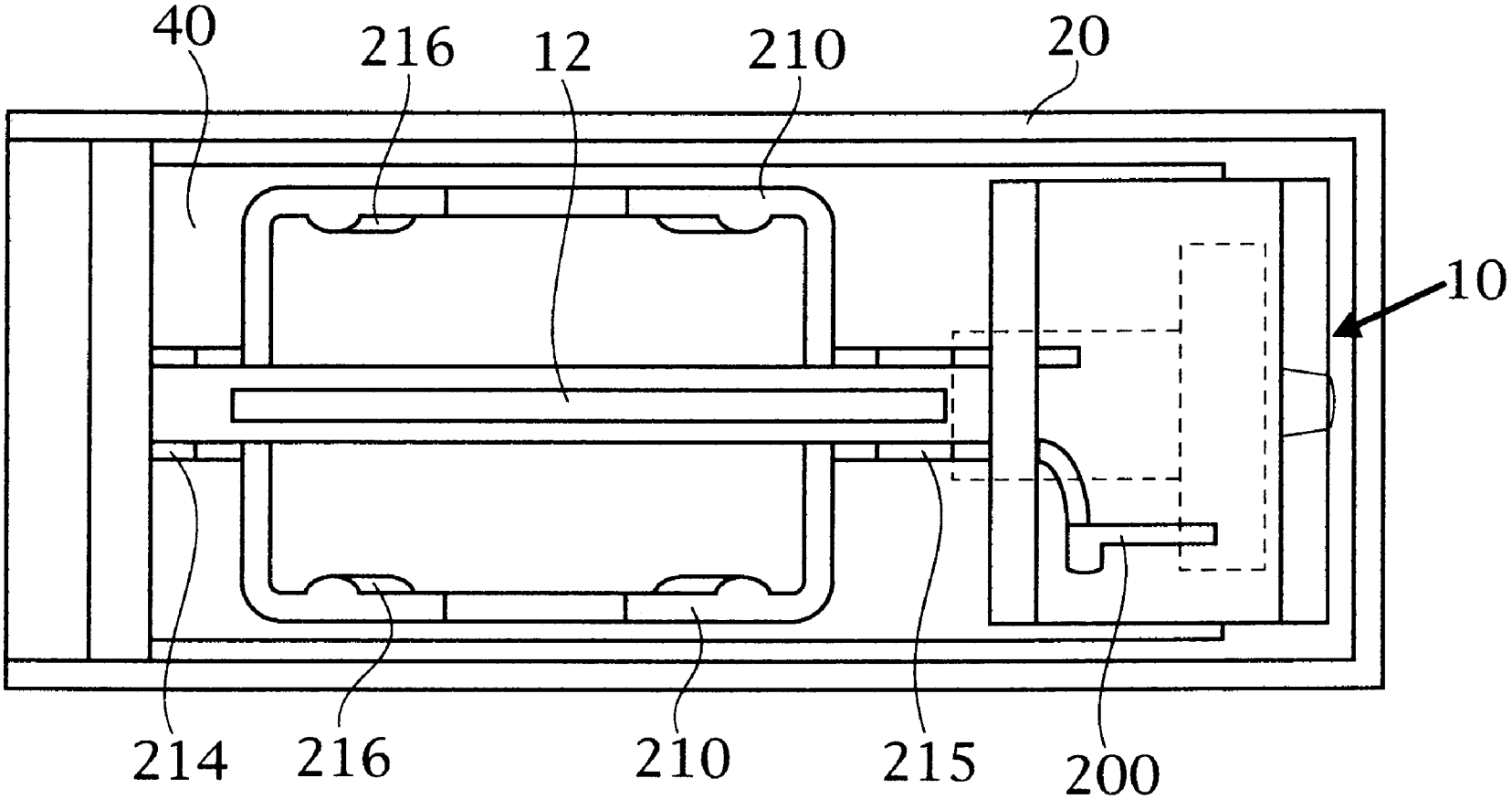
FIG. 5 is a top cut-away view of the bagel slicing appliance of FIGS. 1–4 along section line A—A of FIG. 4.

FIG. 5 is a top cut-away view of the bagel slicing appliance of FIGS. 1–4. It can be seen that food receptacle 40 is provided two, facing, generally unshaped concave sections 210 which serve to hold a bagel 4 or other food item in place while the apparatus is in use. The bottom of each section 210 is supported above horizontal plate 212 using a series of vertical ribs 211 (FIG. 3). However, the sides of each section 210 are surrounded by slots 213 defined by the open space between each section 210, a rear slotted blade guide 214, and a front slotted blade guide 215. The fact that the side walls of each section 210 are surrounded by open slots 213 enables the sidewalls of each section 210 to freely expand radially outwardly, such that food items of various dimensions may be readily received in food receptacle 40. Further, the interior of each section 210 is provided with a rounded flange which serves to frictionally engage a sidewall of the food product, thus preventing the bagel or other item from rotating or otherwise shifting during the cutting operation.

Figure 6:
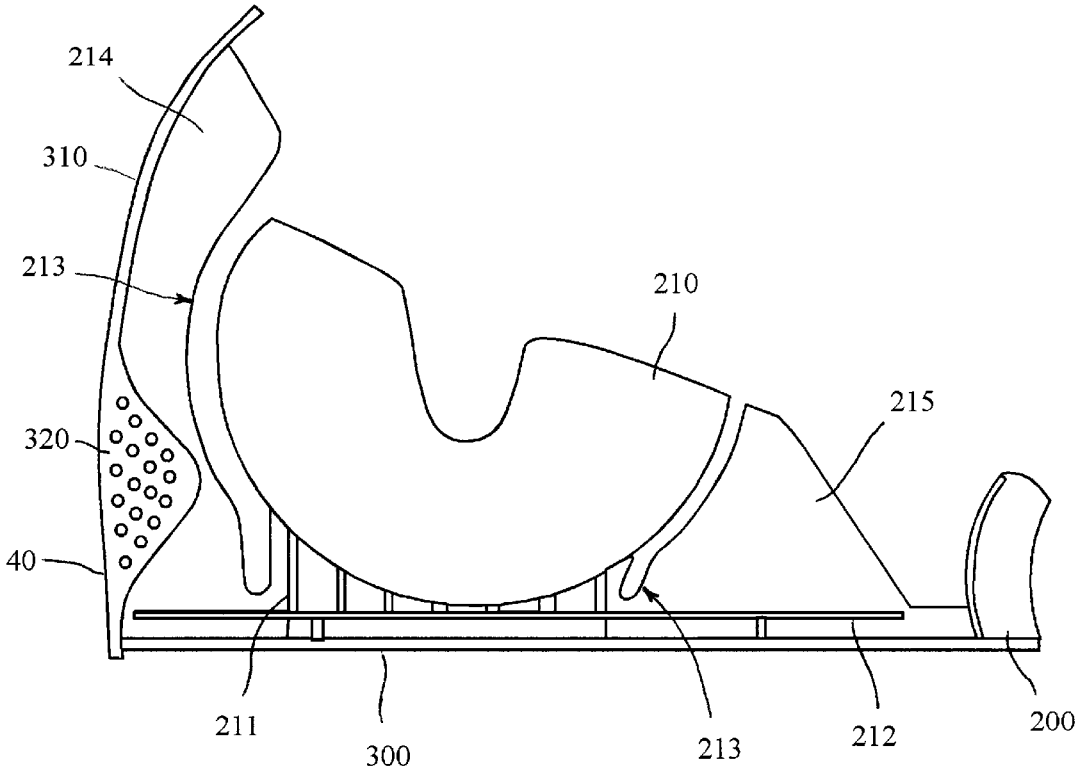
FIGS. 6–8 are an enlarged side view, front view, and top view, respectively, of the food receptacle 40 as shown in FIGS. 1 and 2.
Figure 7:
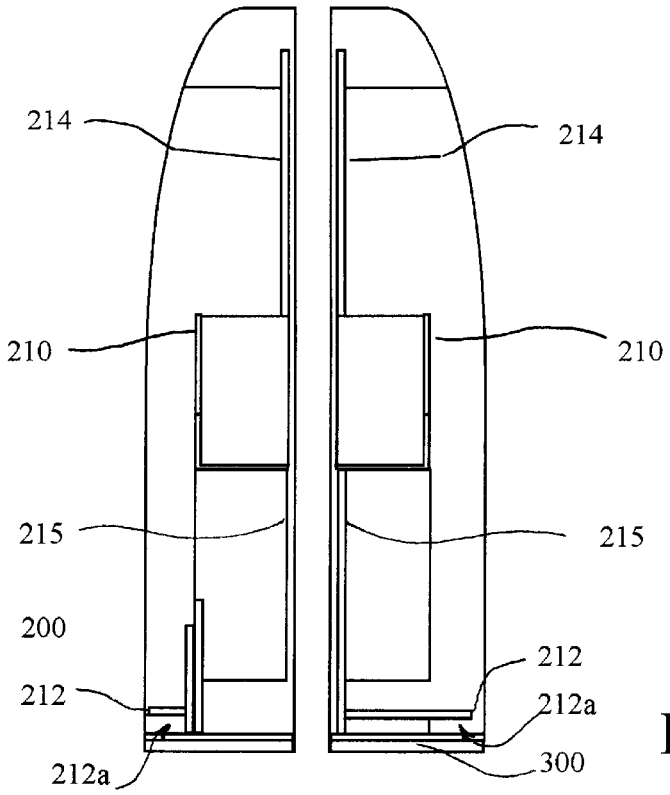
Figure 8:
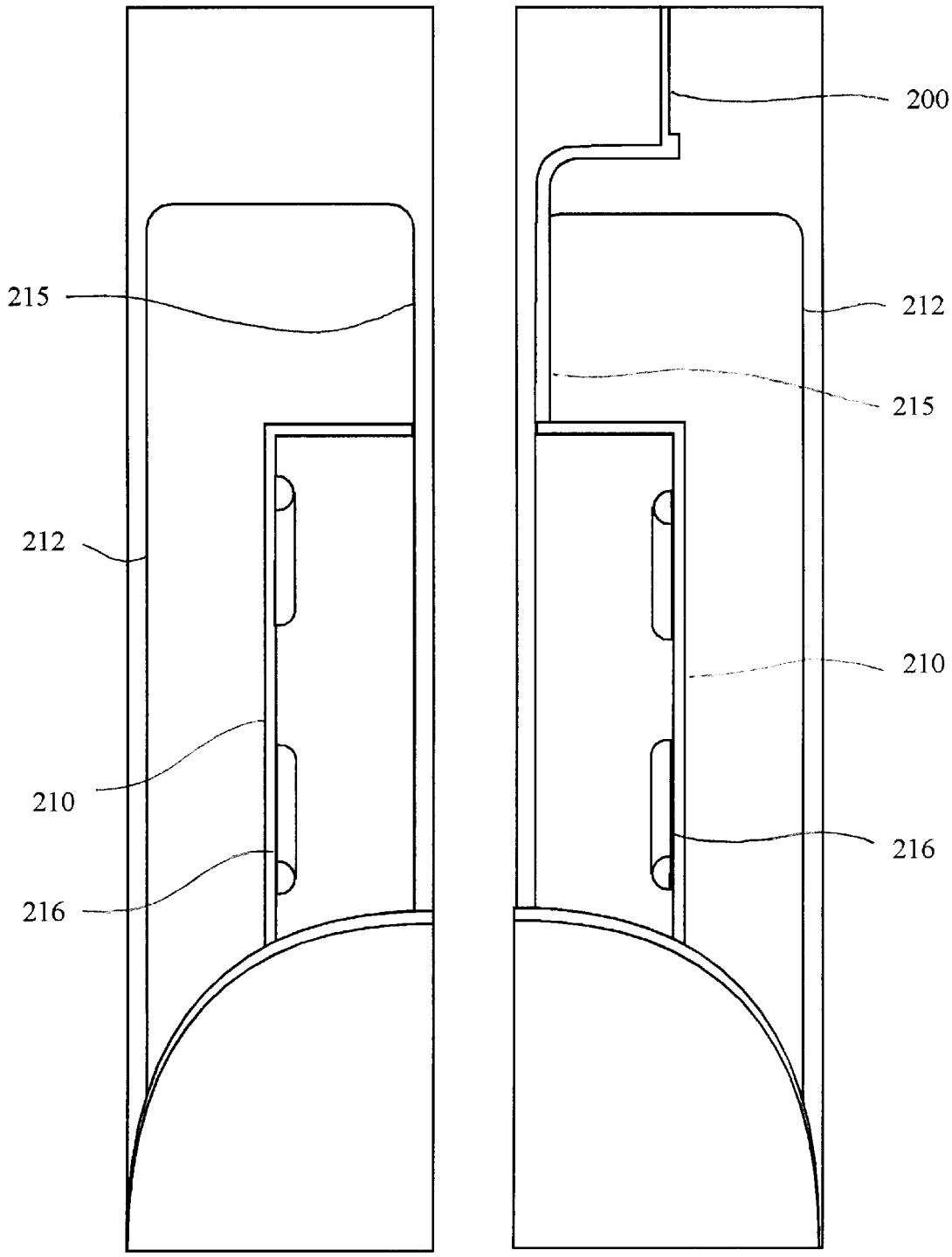

FIGS. 6–8 are an enlarged side view, front view, and top view, respectively, of the food receptacle 40 as shown in FIGS. 1–5. The food receptacle 40 is preferably molded of impact and heat-resistant plastic but may otherwise be formed of any suitable material. The food receptacle is an open enclosure having an integrally formed base 300 and rear handle 310. Base 300 is formed with a small step near its midsection which engages a similarly configured step on the bottom floor of main housing 20. This step serves as a stop to prevent insertion of food tray 40 into main housing 20 beyond that point necessary to engage secondary switch 115*a* with extended finger 200. Likewise, handle 310 is curved to match the contour of the outer, open end of main housing 20. Handle 310 is provided at its lower extent with a laterally raised extension which defines a crumb deflection section 320. Section 320 is configured to forwardly direct any crumbs that fall from the food product as it is being cut, thus preventing the crumbs from collecting in the rear portion of food receptacle 40.

Horizontal support plate 212 is positioned atop stepped base 300 a sufficient distance to create a gap 212*a* between support plate 212 and stepped base 300, which gap is sized to receive ribs 330 (FIG. 2) on the sidewalls of main housing 20. A series of vertical ribs extend upwardly from horizontal support plate 212 and, in turn, support each of the two food item holding sections 210. As mentioned above, a rear knife guide 214 is integrally formed with the food receptacle 40 on the front side of handle section 310, and a front knife guide 215 is integrally formed with the food receptacle 40 near the front portion thereof. Each of knife guides 214 and 215 comprise generally vertically-extending facing panels which define channels therebetween. These channels serve to guide the knife in a straight, downward direction as cutting carriage 10 is pivoted about pivot pin 10*a*.

Open slots 213 are defined by the space between food article carrying sections 210 and each of knife guides 214 and 215. Slots 213 allow the side walls of sections 210 to freely expand outwardly from the center when an oversize food item is inserted into the food receptacle section. Thus, it may readily be seen that sections 210 may receive food products of a variety of sizes.

Extended finger 200 is integrally formed with food receptacle 40 and is positioned at the front most portion. Finger 200 comprises a vertically extending panel which, as explained above, is of sufficient height to engage secondary safety switch 115*a* positioned within cutting carriage 10.

As best seen in FIG. 7, both sides of food receptacle 40 define transverse notches 212*a* running the entire length thereof and adapted to receive and guide insertion via interfitting rails or ribs 330 (FIG. 2) in the main housing 20.

As seen in FIG. 8, the interior of each food article carrying section 210 is provided with raised sections or bosses 216 which help to hold the food item in place when the cutting operation is underway.

Figure 9:
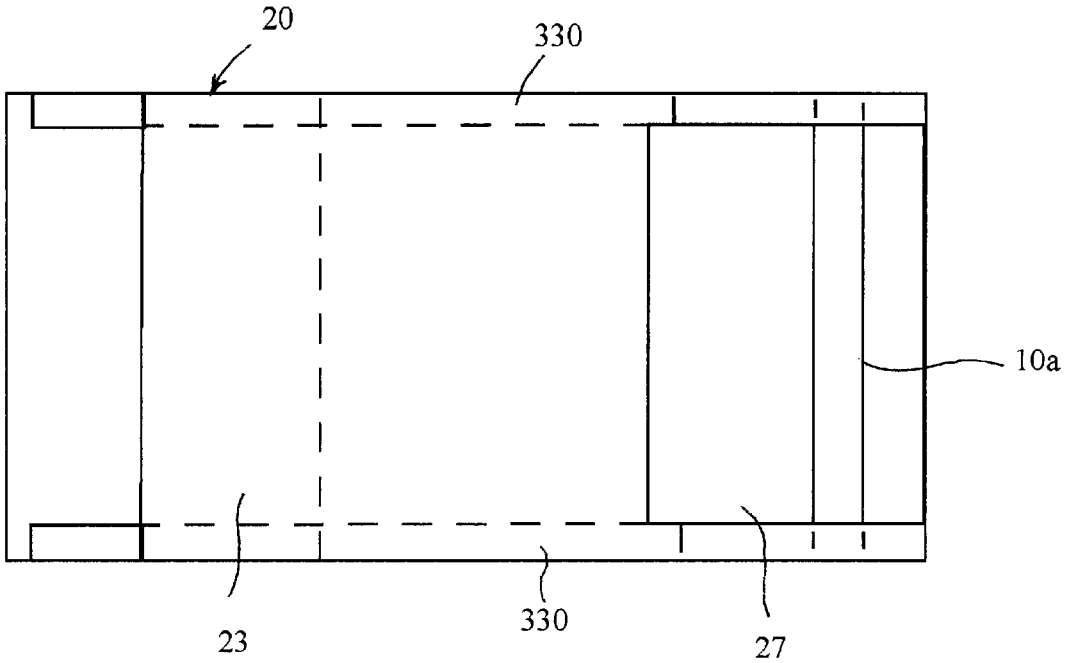
FIGS. 9–11 are an enlarged top view, front view, and side view, respectively, of the main housing 20 as shown in FIGS. 1 and 2.
Figure 10:
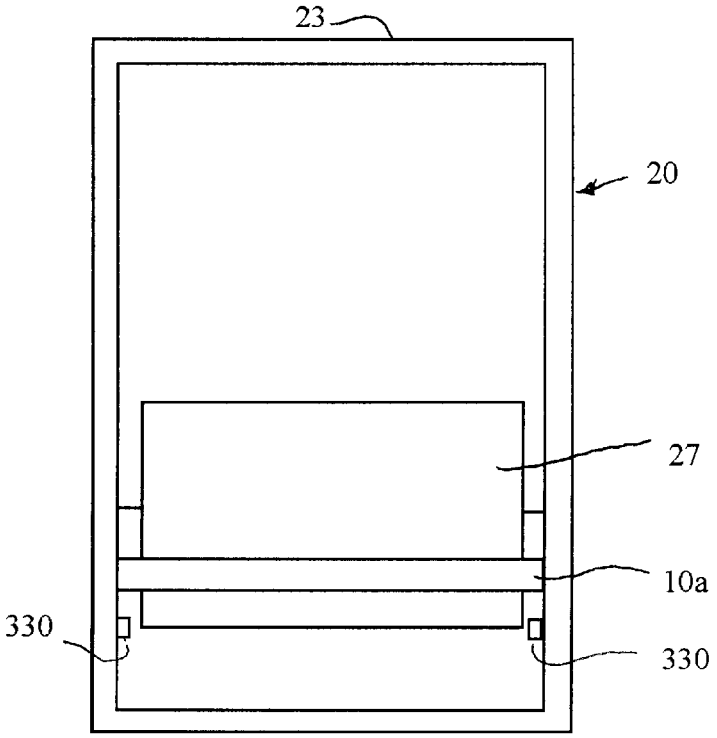
Figure 11:
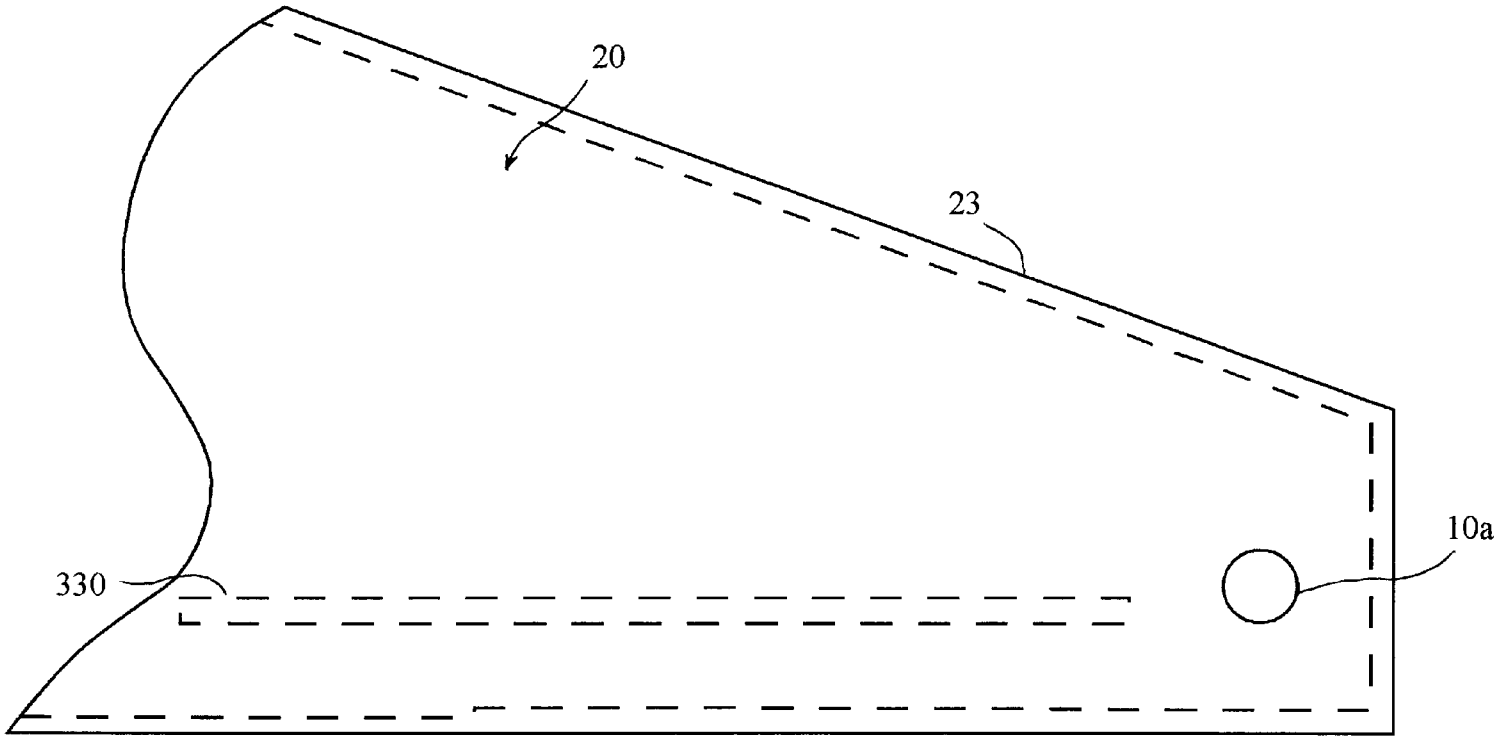

FIGS. 9–11 are an enlarged top view, front view, and side view, respectively, of the main housing 20 as shown in FIGS. 1 and 2. The main housing 20 is preferably likewise molded of heat and impact resistant plastic, but may otherwise be formed of any suitable material. The main housing 20 is an enclosure defined by surrounding walls and an integral bottom panel. The front face of main housing 20 is open and adapted for slidable insertion of food receptacle 40 (with bagel 4 or other food product). Main housing 20 is preferably fitted with top wall 23 for added safety. Top wall 23 covers the entirety of the serrated reciprocating knifes 12 to ensure that a user's fingers cannot come into contact with the cutting instrument. Top wall 23 is provided with a window 27 at its back end such that the handle portion of cutting carriage 10 may extend therethrough. Lateral side rails or ribs 330 are formed on opposing side walls of the interior of main housing 20 and extend lengthwise throughout main housing 20. Side rails 330 are adapted to fit within the transverse notches 212*a* of food receptacle 40 in order to receive and guide insertion of food receptacle 40 into main housing 20. Likewise, the bottom wall of main housing 20 is provided with a stepped configuration which mates with the bottom contour of food receptacle 40 to serve as an abutment for limiting insertion of the food receptacle in main housing 20.

A pivot pin 10*a* spans the width of main housing 20 and is positioned towards the closed end of main housing 20. Pivot pin 10*a* pivotally mounts cutting carriage 10 to main housing 20, with the uppermost portion of cutting carriage 10 extending upward through window 27 in top wall 23. During operation, a user may thus grasp the upper extent of cutting carriage 10 to pivot cutting carriage 10 about pivot pin 10*a*, in turn directing the serrated reciprocating blades 12 downward and through the bagel 4 or other food item, all without the risk of inadvertently coming in contact with blades 12.

Figure 12:
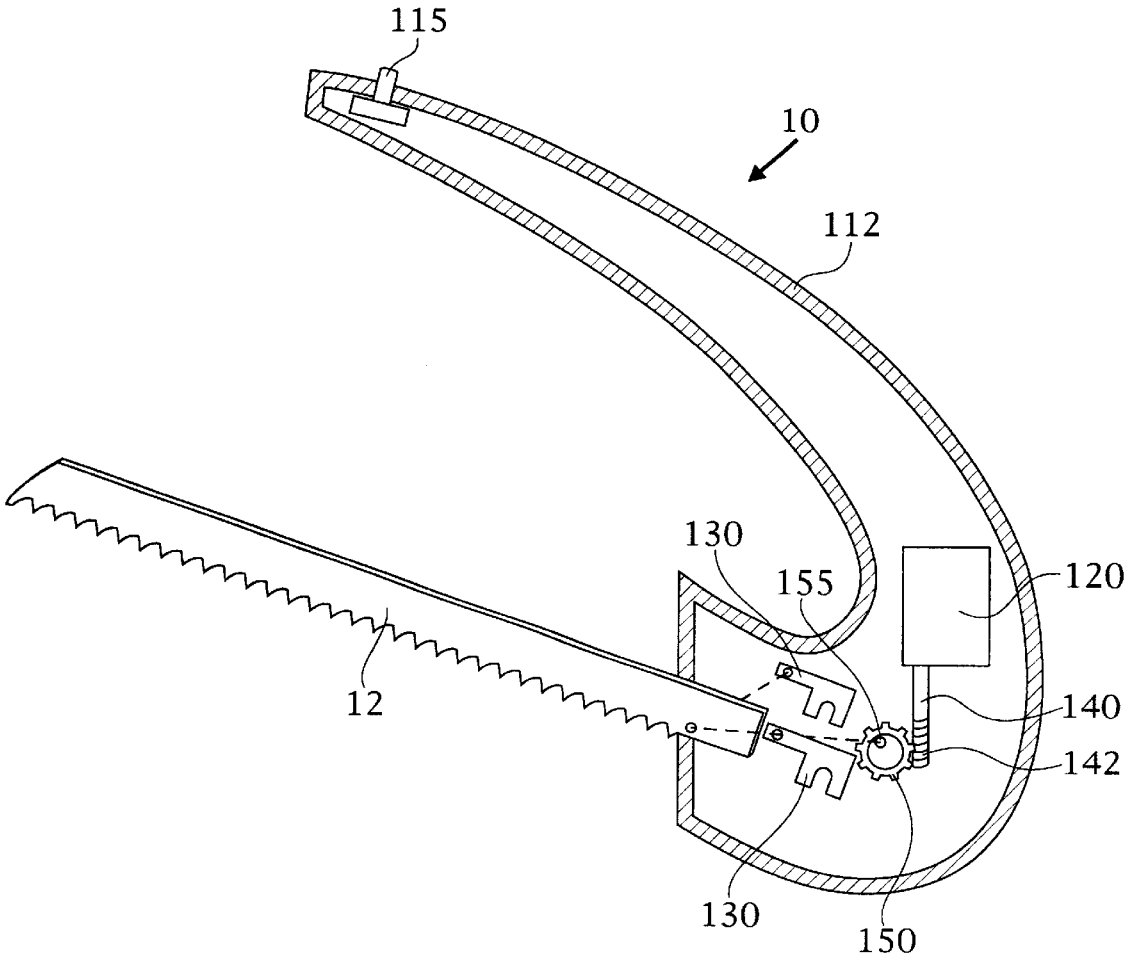
FIG. 12 is an exploded perspective view of the cutting carriage 10 as shown in FIGS. 1 and 2.

FIG. 12 is an exploded view of the cutting carriage 10 as shown in FIGS. 1 and 2. Cutting carriage 10 includes a cutting carriage housing 112, dual serrated reciprocating blade assembly 1312 anchored in the cutting carriage housing 112 and protruding therefrom, and a drive assembly mounted within the cutting carriage housing 112. The drive assembly and dual-serrated blade assembly 12 are commercially available components typically made and sold for powering electric knives. In the present case, UL listed part no. 425C E42169 (available in a unit sold as J. C. Penny Cat. No. 784-4632) is well-suited. As seen in FIG. 12, this drive assembly generally includes a standard 100 Watt Johnson electric motor 120 with an extending drive shaft 140 turning a worm gear 142. Worm gear 142 turns an orthogonally-mounted radial gear 150 having offset drive bits 155 protruding from each face. Drive bits 155 are preferably offset in diametric directions from the center axis of gear 150. Two opposing yoke brackets 130 each have a slot at one end and thereby engage one of the drive bits 155. The other ends of yoke brackets 130 extend outward and are secured to a corresponding blade of the dual-serrated reciprocating blade assembly 12. When activated, the electric motor 120 turns drive shaft 140, which turns worm gear 142, and this turns orthogonally-mounted radial gear 150. Rotation of orthogonally-mounted radial gear 150 causes the offset drive bits 155 to rotate in a circular motion. The rotation of drive bits 155 urges the opposing yoke brackets 130 forward and backward in a reciprocating manner, and since drive bits 155 are offset in diametric directions, the movement of yoke brackets 130 is out of phase. In this manner, the yoke brackets 130 each drive one of the blades of the dual-serrated reciprocating blade assembly 12.

Of course, the above-described drive assembly and dual-serrated reciprocating blade assembly are commercially available components and are described purely for exemplary purposes. It is contemplated that other satisfactory drive assemblies exist, and the use of any would be considered within the spirit and scope of the invention. It is only necessary to reassemble/reorient the drive assembly and dual-serrated reciprocating blade assembly 12 within a suitable cutting carriage housing 112 as will now be described.

Referring once again to FIGS. 1 and 2 and with particular reference to cutting carriage housing 112, the cutting carriage housing 112 is preferably molded of heat and impact resistant plastic but may otherwise be formed of any suitable material. The cutting carriage housing 112 comprises a hollowed arm having an upper portion which extends through the window 27 in the top plate 23 of main housing 20, enabling a user to grip the carriage housing and direct the serrated knives downward and into the bagel 4 or other food product. The bottom portion of cutting carriage housing 112 is provided a through hole 106 (FIG. 2) through which pivot pin 10*a* is placed to pivotally mount cutting carriage housing 112 to main housing 20. The bottom, front portion of cutting carriage housing 112 is open to allow serrated reciprocating knives 12 to extend outward from the cutting carriage housing 112, and to allow vertical extension finger 200 on food receptacle 40 to engage secondary safety switch 115*a*. Secondary safety switch 115*a* is a push-contact on/off switch, and is mounted on the inside of cutting carriage housing 112 to align with finger 200 when food receptacle 40 is fully seated within main housing 20. When food receptacle 40 is so seated, finger 200 depresses switch 115*a*, thus enabling power to flow from the power source to the driving mechanism when main switch 115 is depressed by a user. As the cutting carriage housing 112 is pivoted downward to direct the serrated reciprocating knives 12 through the bagel 4 or other food product, secondary safety switch 115*a* remains depressed by finger 200 and reciprocating blades of slicing assembly 12 pass through the food item 4. When the food item has been completely cut by slicing assembly 12, the user pivots cutting carriage housing 112 to bring slicing assembly 12 out of contact with the food item 4, and withdraws food receptacle 40 from main housing 20. As food receptacle 40 is withdrawn, finger 200 releases secondary safety switch 115*a*, in turn preventing power from flowing from the power source to the driving mechanism and causing inadvertent operation of slicing assembly 12.

It is also of note that when a user starts to downwardly pivot cutting carriage 10 to cause serrated reciprocating knives 12 to cut through the bagel 4 or other food item, the bottom, front portion of cutting carriage housing 112 blocks the retreat of vertical extension finger 200 from within cutting carriage housing 112. Thus, vertical extension finger 200 not only serves to control the activation of switch 115*a*, but also serves as a stop preventing the inadvertent withdrawal of food receptacle 40 from main housing 20 when cutting carriage 10 is pivoted downward to engage the bagel with serrated reciprocating knives 12.

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It is to be understood, therefore, that within the scope of the appended claims, the invention may be practiced otherwise than as specifically set forth herein.

We claim:

1. A food slicing appliance for cutting bagels, baked goods and other food items, comprising:

a main housing for providing support on an existing surface, said main housing defining a walled enclosure having a side aperture and a top aperture;

a food receptacle providing a compartment for seating a food item, said food receptacle being adapted for slidable insertion into the side aperture of said main housing, and said food receptacle having a central channel extending downwardly therethrough, a cutting carriage pivotally attached to said main housing, said cutting carriage comprising a handle extending through the top aperture of said main housing, said cutting carriage further including, a cutting carriage housing, an electric motor mounted within said cutting carriage housing for providing rotary drive, a slicing assembly mounted within said cutting carriage housing, said slicing assembly including an elongate reciprocating blade protruding laterally from said cutting carriage, said blade being disposed over the food receptacle when said food receptacle is inserted into the side aperture of said main housing, and a drive mechanism mounted in said cutting carriage and coupled between said electric motor and reciprocating blade for translating the rotary drive into blade reciprocation to facilitate slicing through the food item;

whereby a food item may be seated in said food receptacle, said food receptacle may be slidably inserted into the side aperture of said main housing, and said cutting carriage may be pivoted with respect to said main housing for driving said reciprocating blade down through said channel in said food receptacle and through the food item seated therein for slicing of the food item.

* * * * *